US009243396B2

(12) United States Patent
Klassen et al.

(10) Patent No.: US 9,243,396 B2
(45) Date of Patent: Jan. 26, 2016

(54) PORTABLE AND EXTENDABLE WOOD DECK

(71) Applicants: Christopher Klassen, Dundurn (CA); Christopher Kratchmer, Outlook (CA)

(72) Inventors: Christopher Klassen, Dundurn (CA); Christopher Kratchmer, Outlook (CA)

( * ) Notice: Subject to any disclaimer, the term of this patent is extended or adjusted under 35 U.S.C. 154(b) by 0 days.

(21) Appl. No.: 14/147,792

(22) Filed: Jan. 6, 2014

(65) Prior Publication Data

US 2014/0190092 A1 Jul. 10, 2014

Related U.S. Application Data

(60) Provisional application No. 61/748,876, filed on Jan. 4, 2013.

(51) Int. Cl.
*E04B 1/00* (2006.01)

(52) U.S. Cl.
CPC ..... *E04B 1/003* (2013.01)

(58) Field of Classification Search
CPC . E04B 1/003; E04B 1/34336; E04F 15/02183
USPC ..... 52/79.5, 79.6, 263, 183, 143, 67, 7
See application file for complete search history.

(56) References Cited

U.S. PATENT DOCUMENTS 4,622,792 A * 11/1986 Betts ..... 52/263
4,628,645 A * 12/1986 Tafelski, Jr. ..... 52/169.1
4,647,107 A 3/1987 Hoover et al.
4,691,484 A 9/1987 Wilson
4,735,023 A * 4/1988 Posner ..... 52/66
4,823,529 A * 4/1989 Canfield et al. ..... 52/263
4,833,842 A 5/1989 Anastasio
4,852,309 A * 8/1989 Stamp, Sr. ..... 52/79.6
5,421,131 A * 6/1995 Heckman et al. ..... 52/263
5,469,794 A * 11/1995 Laderoute et al. ..... 108/48
6,061,991 A 5/2000 Dahl
7,429,077 B2 9/2008 Yul
7,686,381 B1 * 3/2010 Leonard ..... 296/162
8,011,148 B2 9/2011 Bertke et al.

* cited by examiner

*Primary Examiner* — Jeanette E Chapman
*Assistant Examiner* — Daniel Kenny
(74) *Attorney, Agent, or Firm* — Buckingham, Dolittle & Burroughs, LLC

(57) ABSTRACT

An extendable deck device is disclosed that creates additional room for homes with limited outdoor space. The extendable deck device comprises a plurality of squares, with each square comprising a frame and a plurality of support beams secured thereto, and a floor component positioned on top of the plurality of squares to substantially cover the plurality of squares. The extendable deck device further comprises at least one rail component secured to a perimeter edge of the floor component, which protrudes vertically upwards from the floor component. The rail components can be extended or retracted either manually or via an electric motor and reel. Further, the deck device can comprise at least one set of stairs secured underneath a corner of the floor component. The stairs can be secured to the corner, such that a user manually extends out the stairs from underneath the floor component for use.

9 Claims, 5 Drawing Sheets

PORTABLE AND EXTENDABLE WOOD DECK

CROSS-REFERENCE

This application claims priority from Provisional Patent Application Ser. No. 61/748,876 filed Jan. 4, 2013.

BACKGROUND

Individuals living in townhouses and other planned communities generally have to abide by homeowner agreements that include building restrictions. Further, building an enclosed deck within the set area may create a tight, confined space that cannot comfortably hold many people, while keeping the space open does not provide sufficient privacy. An effective solution is necessary.

The present invention enables users to expand their deck space easily and temporarily as needed, and adheres to homeowner agreements that prohibit building a certain distance beyond a cement deck platform. The extendable deck device offers additional features such as handrails and benches, and provides sufficient space underneath for an A/C unit. Additionally, the deck device utilizes a level design so a step is not needed to access the deck from the door of the home.

SUMMARY

The following presents a simplified summary in order to provide a basic understanding of some aspects of the disclosed innovation. This summary is not an extensive overview, and it is not intended to identify key/critical elements or to delineate the scope thereof. Its sole purpose is to present some concepts in a simplified form as a prelude to the more detailed description that is presented later.

The subject matter disclosed and claimed herein, in one aspect thereof, comprises an extendable deck device that creates additional room for homes with limited outdoor space. The extendable deck device comprises a plurality, of squares, with each square comprising a frame and a plurality of support beams secured thereto, and a floor component positioned on top of the plurality of squares to substantially cover the plurality of squares. The plurality of squares can be arranged to cover an existing cement pad, or other surface. The plurality of support beams are secured to the frame at either the first set of opposing ends or the second set of opposing ends, spanning the length or the width of the frame, depending on which set of opposing ends the support beams are secured to. The extendable deck device further comprises at least one rail component secured to a perimeter edge of the floor component, which protrudes vertically upwards from the floor component. The rail components can be extended out flat, till they are flush with the floor component, or can be retracted upwards, till the rail components are vertical with the floor component. Further, the rail components can be extended or retracted manually, or via an electric motor and reel.

In a preferred embodiment, the extendable deck device comprises at least one bench component and at least one table component secured to a perimeter edge of the floor component via hinges or other suitable securing means, such that the bench component and/or the table component can pivot up and down. The extendable deck device further comprises at least one set of stairs secured underneath a corner of the floor component. The stairs can be secured to the corner of the floor component via a hinge or other suitable securing means, as long as the stairs can pivot up and down. Typically, a user manually extends out the stairs from underneath the floor component for use.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and is intended to include all such aspects and their equivalents. Other advantages and novel features will become apparent from the following detailed description when considered in conjunction with the drawings.

DESCRIPTION OF PREFERRED EMBODIMENTS

Figure 1:
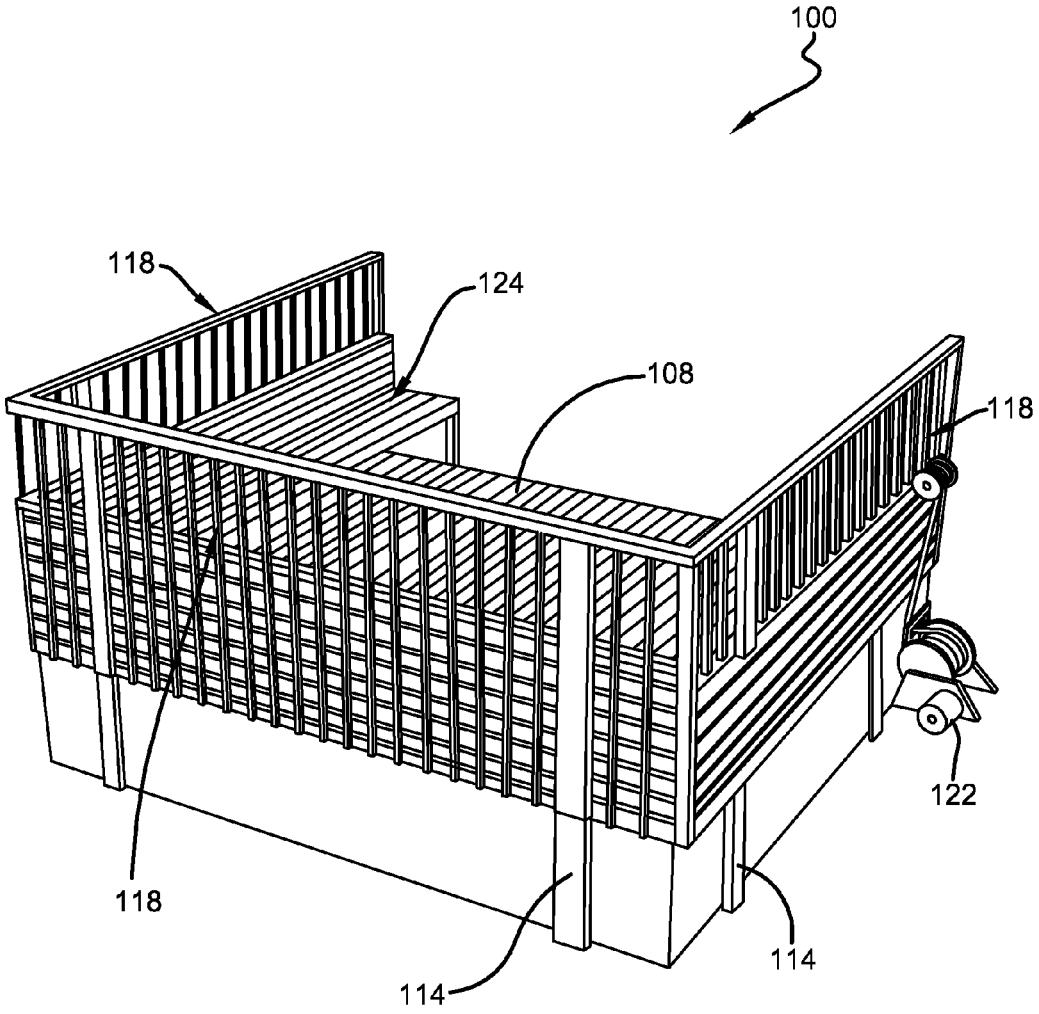
FIG. 1 illustrates a perspective view of the extendable deck device in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof The present invention enables users to expand their deck space easily and temporarily as needed, and adheres to homeowner agreements that prohibit building a certain distance beyond a cement deck platform. The extendable deck device offers additional features such as handrails and benches, and provides sufficient space underneath for an A/C unit. Additionally, the deck device utilizes a level design so a step is not needed to access the deck from the door of the home.

The disclosed extendable deck device comprises a plurality of squares, with each square comprising a frame and a plurality of support beams secured thereto, and a floor component positioned on top of the plurality of squares to substantially cover the plurality of squares. The plurality of squares can be arranged to cover an existing cement pad, or other surface. The extendable deck device further comprises at least one rail component secured to a perimeter edge of the floor component, which protrudes vertically upwards from the floor component. The rail components can be extended or retracted either manually or via an electric motor and reel. Further, the deck device can comprise at least one set of stairs secured underneath a corner of the floor component. The stairs can be secured to the corner of the floor component, such that a user manually extends out the stairs from underneath the floor component for use.

Figure 2:
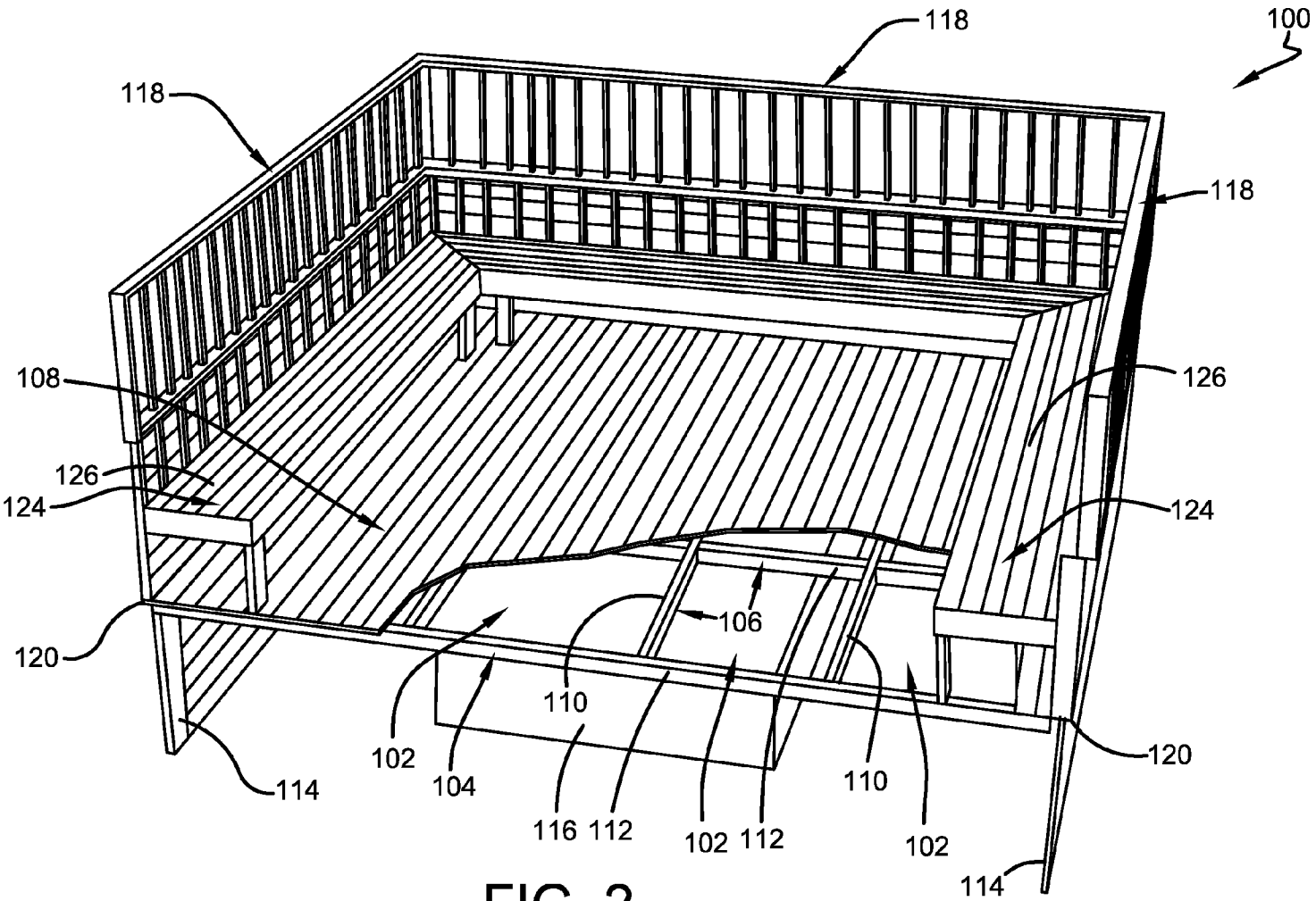
FIG. 2 illustrates a top perspective view of the extendable deck device with the bench components in accordance with the disclosed architecture.
Figure 3:
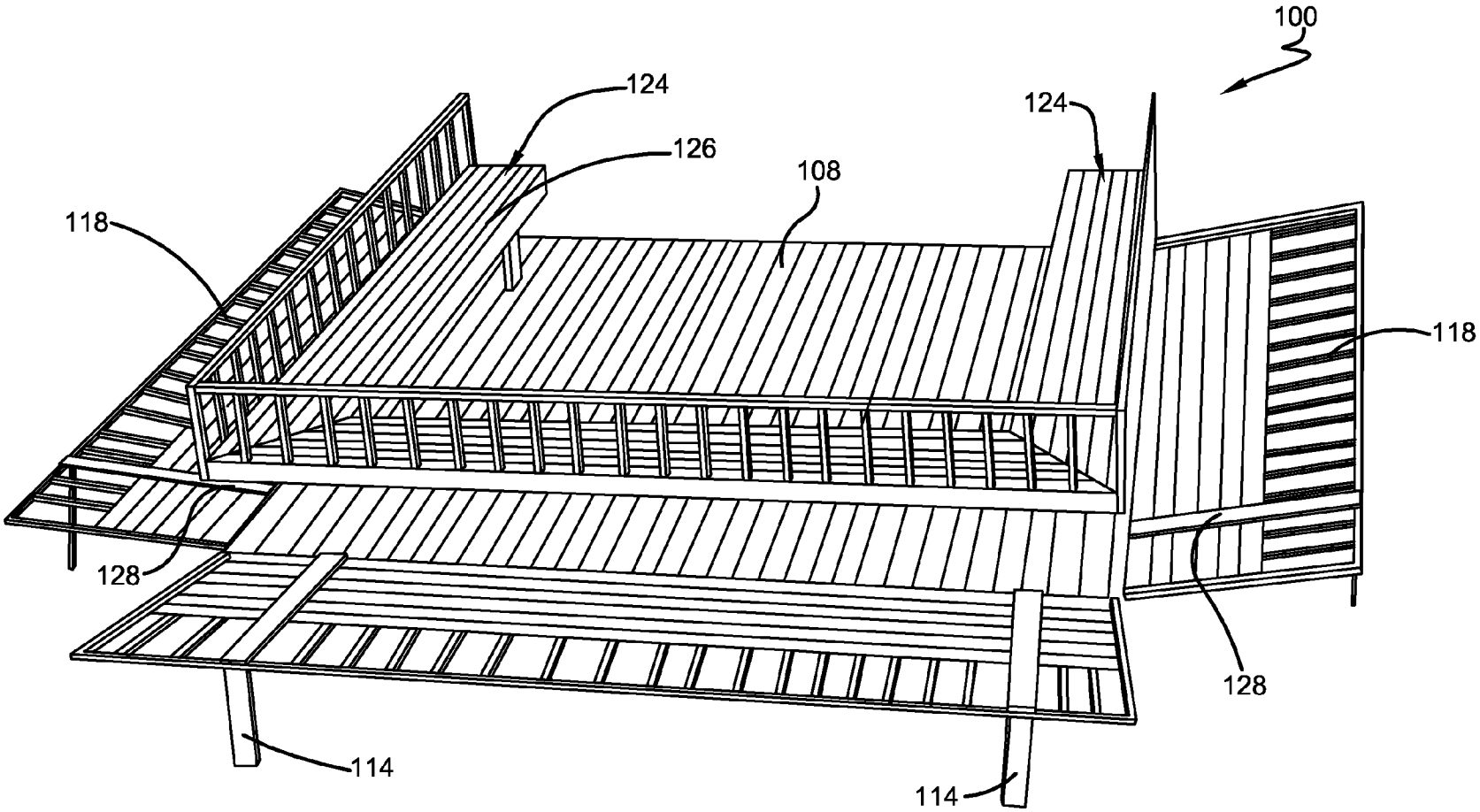
FIG. 3 illustrates a top perspective view of the extendable deck device with the rail components extended out in accordance with the disclosed architecture.

Referring initially to the drawings, FIGS. 1-3 illustrate the extendable deck device 100 (which is a folding, extendable deck) that creates additional room for homes with limited outdoor space. The extendable deck device 100 comprises a plurality of squares 102, with each square 102 comprising a frame 104 and a plurality of support beams 106 secured thereto, and a floor component 108 positioned on top of the plurality of squares 102 to substantially cover the plurality of squares 102 (as shown in FIG. 1).

The plurality of squares 102 can be any suitable shape and size and can comprise any suitable number of squares 102, depending on the wants and needs of a user. Preferably, the squares 102 can be arranged to cover an existing cement pad (not shown), or other surface, but can be arranged in any suitable shape to cover any size area, depending on the wants and needs of a user, and on the amount of outdoor space available. Each square 102 comprises a frame 104 and a plurality of support beams 106 secured thereto. The frame 104 comprises a first set of opposing members 110, and a second set of opposing members 112, and is approximately between 4 and 11 feet long from opposing members 110, and approximately between 4 and 12 feet wide from opposing members 112.

A plurality of support beams 106 are then secured to the frame 104 at either the first set of opposing members 110 or the second set of opposing members 112, spanning the length or the width of the frame 104, depending on which set of opposing members the support beams 106 are secured to. The support beams 106 are secured to the opposing members 110 or 112 of the frame 104 via any suitable securing means as is known in the art, such as welding, gluing, fasteners, etc.

The support beams 106 would be any suitable size and shape as known in the art, as long as the support beams 106 span the length or width of the frame 104 and secure to the opposing members 110 or 112. The frame 104 and support beams 106 would generally both be constructed of the same material, metal, treated wood, CMF (Columbus Modified Fiber) wood, etc., though any other suitable material may be used to manufacture the frame 104 and support beams 106 as is known in the art without affecting the overall concept of the invention, as long as the material is generally strong enough to withstand a weight of 3,000-4,000 lbs.

The plurality of squares 102 can be positioned directly on the ground or cement pad in the desired configuration, or can be supported by legs 114 and/or a base 116 above the ground or cement pad. Once in the desired position, the plurality of squares 102 is then substantially covered by a floor component 108. The floor component 108 can be any suitable size and shape as is known in the art as long as the floor component 108 substantially covers the plurality of squares 102.

The floor component 108 would generally be constructed of wood, etc., though any other suitable material may be used to manufacture the floor component 108 as is known in the art without affecting the overall concept of the invention, as long as the material is generally strong enough to withstand a weight of 3,000-4,000 lbs., and is generally weather-resistant. The floor component 108 can also comprise a variety of colors and designs to suit user and manufacturing preference.

The extendable deck device 100 further comprises at least one rail component 118 secured to a perimeter edge 120 of the floor component 108. The rail component 118 can be any suitable size and shape as is known in the art, and functions as a typical prior art rail component 118. Multiple rail components 118 can be secured to the entire perimeter edge 120 of the floor component 108, or only a few rail components 118 can be secured to specific sections of the perimeter edge 120 of the floor component 108. The rail components 118 are secured to the perimeter edge 120 of the floor component 108 and protrude vertically upwards from the floor component 108. The rail components 118 can be secured to the perimeter edge 120 of the floor component 108 via any suitable securing means as is known in the art, such as a hinge, etc., as long as the rail components 118 can extend and retract.

Specifically, the rail components 118 can extend out flat (horizontally), till they are flush with the floor component 108, or can retract upwards (vertically), till the rail components 118 are vertical with (at a substantially 90 degree angle with) the floor component 108 (as shown in FIG. 3). Further, the rail components 118 can be extended or retracted manually via hinges and locks, or the rail components 118 can be connected to an electric motor and reel 122 which extends and retracts the rail components 118 automatically. The rail components 118 would generally be constructed of wood, etc., though any other suitable material may be used to manufacture the rail components 118 as is known in the art without affecting the overall concept of the invention, as long as the material is generally strong enough to withstand a weight of 600-800 lbs., and is generally weather-resistant. The rail components 118 can also comprise a variety of colors and designs to suit user and manufacturing preference.

The extendable deck device 100 further comprises at least one bench component 124 secured to a perimeter edge 120 of the floor component 108. The bench component 124 can be any suitable size and shape as is known in the art, and functions as a typical prior art bench component 124. Multiple bench components 124 can be secured to the entire perimeter edge 120 of the floor component 108, or only a few bench components 124 can be secured to specific sections of the perimeter edge 120 of the floor component 108. The bench components 124 are secured to the perimeter edge 120 of the floor component 108, such that a flat surface 126 is exposed for seating (as shown in FIG. 2).

The bench components 124 can be secured to the perimeter edge 120 of the floor component 108 via any suitable securing means as is known in the art, such as a hinge, etc., as long as the bench components 124 can pivot up and down, and/or slide along the extended rail components 118. For example, when the rail components 118 are fully extended horizontally, such that they are flush with the floor component 108, the bench components 124 can then be slid along rails 128 or other guides till the bench components 124 are positioned at an end 130 of the rail components 118, to enlarge the useable deck area. Additionally, the bench components 124 can comprise a cushion 132 or other accessory. The cushion 132 would comprise plastic, vinyl, or other suitable waterproof material as is known in the art.

The bench components 124 would generally be constructed of wood, etc., though any other suitable material may be used to manufacture the bench components 124 as is known in the art without affecting the overall concept of the invention, as long as the material is generally strong enough to withstand a weight of 600-800 lbs., and is generally weather-resistant. The bench components 124 can also comprise a variety of colors and designs to suit user and manufacturing preference.

The extendable deck device 100 further comprises at least one table component 134 secured to a perimeter edge 120 of the floor component 108. The table component 134 can be any suitable size and shape as is known in the art, and functions as a typical prior art table component 134. Multiple table components 134 can be secured to the perimeter edge 120 of the floor component 108, and are secured to the perimeter edge 120 of the floor component 108, such that a flat surface is exposed. Typically, the table components 134 are secured to a corner of the floor component 108, but they do not need to be, and can be secured anywhere along the perimeter edge 120 of the floor component 108, depending on the wants and needs of a user. The table components 134 can be secured to the perimeter edge 120 of the floor component 108 via any suitable securing means as is known in the art, such as a hinge, etc., as long as the table components 134 can pivot up and down.

The table components 134 would generally be constructed of wood, etc., though any other suitable material may be used to manufacture the table components 134 as is known in the art without affecting the overall concept of the invention, as long as the material is generally strong enough to withstand a weight of 200 lbs., and is generally weather-resistant. The table components 134 can also comprise a variety of colors and designs to suit user and manufacturing preference.

The extendable deck device 100 further comprises at least one set of stairs 136 secured to a corner 138 of the floor component 108. The stairs 136 can be any suitable size and shape as is known in the art, and functions as typical prior art stairs 136. Multiple sets of stairs 136 can be secured to the floor component 108, with typically one set of stairs 136 being secured at each corner 138. Typically, the stairs 136 are secured underneath the corners 138 of the floor component 108, but they do not need to be, and can be secured on top of the floor component 108 as well, depending on the wants and needs of a user. The stairs 136 can be secured to the corner 138 of the floor component 108 via any suitable securing means as is known in the art, such as a hinge, etc., as long as the stairs 136 can pivot up and down. Typically, a user can manually extend out the stairs 136 from underneath the floor component 108 for use.

The stairs 136 would generally be constructed of wood, etc., though any other suitable material may be used to manufacture the stairs 136 as is known in the art without affecting the overall concept of the invention, as long as the material is generally strong enough to withstand a weight of 200-300 lbs., and is generally weather-resistant. The stairs 136 can also comprise a variety of colors and designs to suit user and manufacturing preference.

Figure 4:
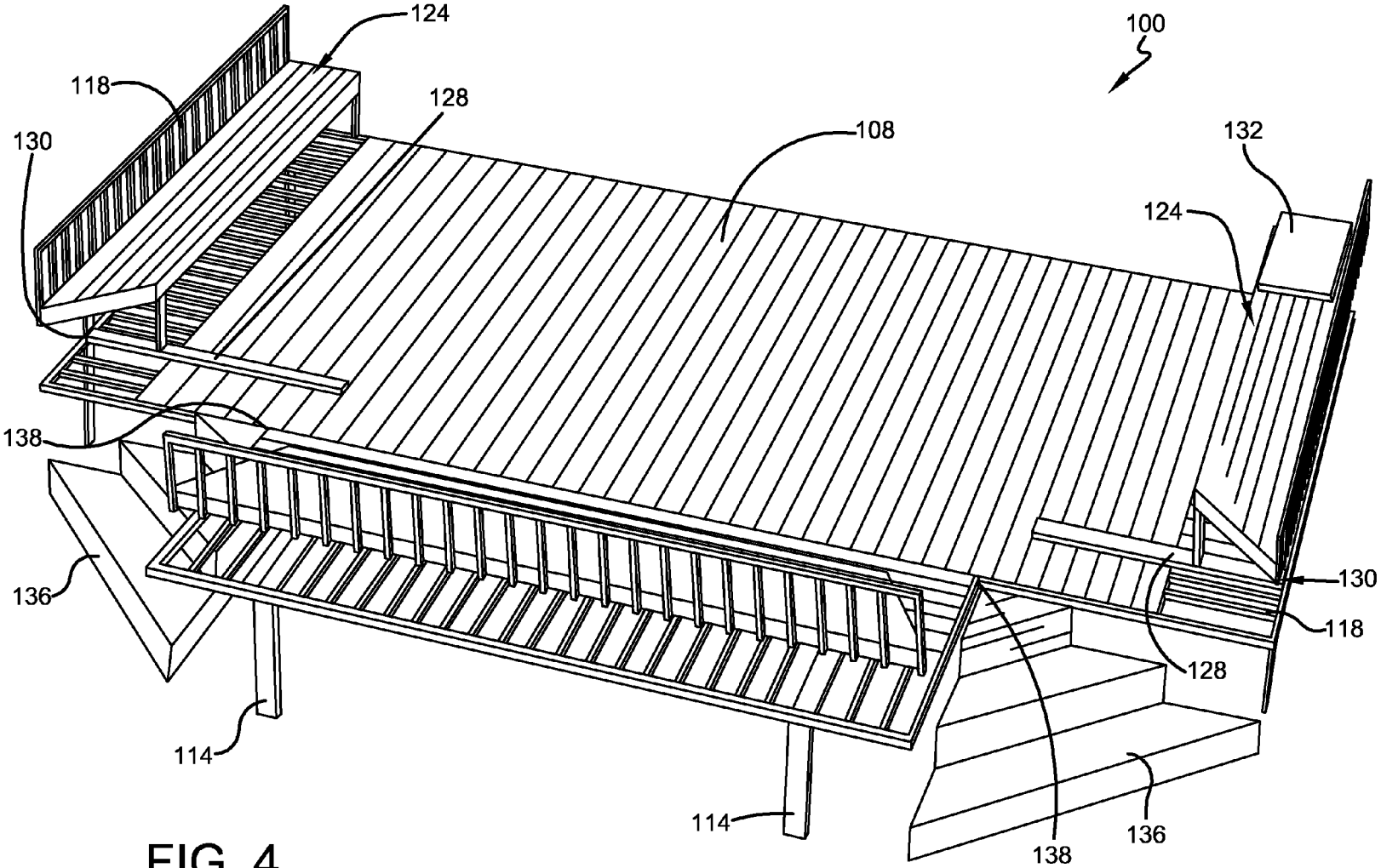
FIG. 4 illustrates a top perspective view of the extendable deck device with the steps extended in accordance with the disclosed architecture.

FIG. 4 illustrates the extendable deck device 100 with the steps (or stairs) 136 extended. As stated supra, the extendable deck device 100 comprises at least one set of stairs 136 secured to a corner 138 of the floor component 108. The stairs 136 can be any suitable size and shape as is known in the art, and functions as typical prior art stairs 136. The stairs 136 would generally be constructed of wood, etc., though any other suitable material may be used to manufacture the stairs 136 as is known in the art without affecting the overall concept of the invention, as long as the material is generally strong enough to withstand a weight of 250-300 lbs., and is generally weather-resistant. The stairs 136 can also comprise a variety of colors and designs to suit user and manufacturing preference.

Multiple sets of stairs 136 can be secured to the floor component 108, with typically one set of stairs 136 being secured at each corner 138. Typically, the stairs 136 are secured underneath the corners 138 of the floor component 108, but they do not need to be, and can be secured on top of the floor component 108 as well, depending on the wants and needs of a user. The stairs 136 can be secured to the corner 138 of the floor component 108 via any suitable securing means as is known in the art, such as a hinge, etc., as long as the stairs 136 can pivot up and down. Typically, a user can manually extend out the stairs 136 from underneath the floor component 108 for use.

Figure 5:
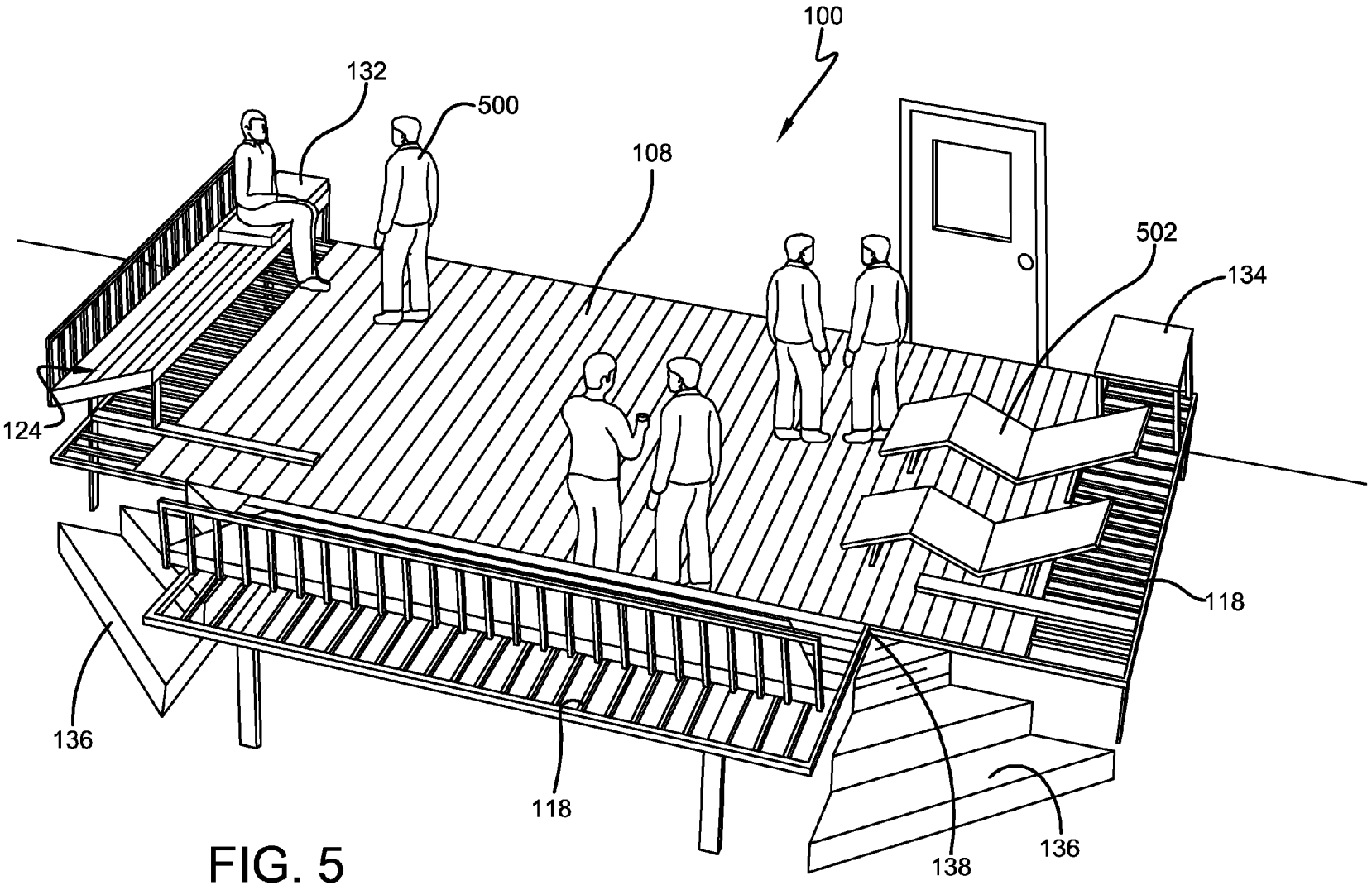
FIG. 5 illustrates a perspective view of the extendable deck device in use in accordance with the disclosed architecture.

FIG. 5 illustrates the extendable deck device 100 in use. As stated supra, the extendable deck device 100 comprises a plurality of squares 102, with each square 102 comprising a frame 104 and a plurality of support beams 106 secured thereto, and a floor component 108 positioned on top of the plurality of squares 102 to substantially cover the plurality of squares 102. The plurality of squares 102 can be arranged to cover an existing cement pad, or other surface. The extendable deck device 100 further comprises at least one rail component 118 secured to a perimeter edge 120 of the floor component 108, which protrudes vertically upwards from the floor component 108, and can be extended or retracted. Further, the deck device 100 can comprise at least one set of stairs 136 secured underneath a corner 138 of the floor component 108, and other accessories, such as a bench component 124 or a table component 134 secured to the floor component 108.

In operation, a user 500 chooses the configuration and/or design of the plurality of squares 102 of the extendable deck device 100 that meets their needs and wants. The user 500 then positions the plurality of squares 102 in the desired configuration on a cement pad or other surface. Once in the desired configuration, the user 500 positions the floor component 108 substantially over the plurality of squares 102, securing the plurality of squares 102 together. Once secure, the user 500 then secures and positions the desired number of rail components 118 to the perimeter edge 120 of the floor component 108. Once in position, the user 500 retracts or extends the rail components 118 to the desired position, then secures the rail components 118 in place.

The user 500 can then secure and position the desired number of bench components 124 or table components 134 to the perimeter edge 120 of the floor component 108, or other accessories 502. Once in position, the user 500 can pivot the bench components 124 or table components 134 to the desired position. The user 500 can then secure and position the desired number of sets of stairs 136 to the corners 138 of the floor component 108. Once in position, the user 500, can extend or retract the set of stairs 136 to the desired position. Accordingly, the deck device 100 enables users 500 to expand their deck space easily and temporarily as needed, and adheres to homeowner agreements that prohibit building a certain distance beyond a cement deck platform. The extendable deck device 100 offers additional features such as handrails and benches, and provides sufficient space underneath for an A/C unit (as shown in FIG. 5).

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. An extendable deck device comprising:

plurality of squares, each square comprising a frame and a plurality of support beams secured thereto;

wherein the frame comprises a first set of opposing members and a second set of opposing members, and the plurality of support beams span a width of the frame and are secured to either the first set or the second set of opposing members; and a floor component positioned on top of the plurality of squares;

wherein the floor component substantially covers the plurality of squares; and at least one rail component pivotally secured to a perimeter edge of the floor component;

wherein the at least one rail component is connected to an electric motor and reel which extends and retracts the at least one rail component from between a horizontal orientation substantially flush with the floor component and a vertical orientation substantially perpendicular to the floor component.

2. The extendable deck device of claim 1, further comprising at least one bench component secured to a perimeter edge of the floor component.

3. The extendable deck device of claim 2, further comprising a rail attached to the floor component, wherein the at least one bench component is secured to the perimeter edge via a hinge which allows the at least one bench component to pivot along the perimeter edge and to slideably engage the rail as the rail component is moved to the horizontal orientation substantially flush with the floor component.

4. The extendable deck device of claim 3, wherein the at least one bench component comprises a cushion.

5. The extendable deck device of claim 1, further comprising at least one table component secured to a perimeter edge of the floor component.

6. The extendable deck device of claim 1, further comprising at least one set of stairs secured to a corner of and underneath the floor component.

7. The extendable deck device of claim 6, wherein the at least one set of stairs is secured via a hinge, such that a user can manually extend out the at least one set of stairs from underneath the floor component for use.

8. The extendable deck device of claim 1, wherein the floor component is comprised of wood.

9. The extendable deck device of claim 1, wherein the frame is comprised of metal.

* * * * *